US007657197B2

(12) United States Patent
Yoshikawa

(10) Patent No.: US 7,657,197 B2
(45) Date of Patent: Feb. 2, 2010

(54) IMAGE FORMING APPARATUS EMPLOYING A CLEANER-LESS SYSTEM

(75) Inventor: Tadanobu Yoshikawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 11/947,064

(22) Filed: Nov. 29, 2007

(65) Prior Publication Data

US 2008/0131153 A1 Jun. 5, 2008

(30) Foreign Application Priority Data

Dec. 5, 2006 (JP) ..... 2006-328097

(51) Int. Cl.
*G03G 15/00* (2006.01)
*G03G 15/02* (2006.01)

(52) U.S. Cl. ..... 399/50; 399/129; 399/149

(58) Field of Classification Search ..... 399/50, 399/149, 150, 128, 129
See application file for complete search history.

(56) References Cited

U.S. PATENT DOCUMENTS 5,701,559 A * 12/1997 Ootaka et al. ..... 399/149
5,970,302 A * 10/1999 Yamane ..... 399/50 X
6,421,512 B2 7/2002 Watanabe et al. ..... 399/149
6,782,215 B2 8/2004 Komori ..... 399/50
7,444,092 B2 * 10/2008 Naito et al. ..... 399/50
2003/0049048 A1 * 3/2003 Yoshikawa et al. ..... 399/129
2004/0005160 A1 * 1/2004 Kawamura et al. ..... 399/149 X
2005/0260006 A1 * 11/2005 Matsuda et al. ..... 399/50

FOREIGN PATENT DOCUMENTS

JP 2001-183905 7/2001
JP 2001-215798 8/2001
JP 2003-295584 10/2003
JP 2004-117599 4/2004
JP 2004-191766 7/2004

OTHER PUBLICATIONS

Official Letter (English Translation)/Search Report, dated Apr. 10, 2009, issued by the Chinese Patent Office, in Chinese Patent Application No. 200710196488X.

* cited by examiner

*Primary Examiner*—Sophia S Chen
(74) *Attorney, Agent, or Firm*—Fitzpatrick, Cella, Harper & Scinto

(57) ABSTRACT

An image forming apparatus performs a control sequence in which an AC voltage having a peak-to-peak voltage is applied to a charging member so that a relationship between an absolute value of a surface potential of an image bearing member at a portion under a transfer residual toner remaining on the image bearing member which has been electrically charged by the charging member during non-image formation and an absolute value of a surface potential of a developer carrying member is reversed with respect to a relationship between these absolute values during image formation.

3 Claims, 10 Drawing Sheets

IMAGE FORMING APPARATUS EMPLOYING A CLEANER-LESS SYSTEM

FIELD OF THE INVENTION AND RELATED ART

The present invention relates to a cleaner-less image forming apparatus. More specifically, the present invention relates to a cleaner-less image forming apparatus in which a developer (toner) remaining on an image bearing member after a transfer step is removed and collected from the image bearing member by a developing apparatus through simultaneous development and cleaning and is used again to omit a cleaning apparatus.

An image forming apparatus of a transfer type using electrophotography such as a copying machine, a printer, or a facsimile apparatus have conventionally included a photosensitive member as an image bearing member generally of a rotationally driven drum type. The image forming apparatus further includes a charging apparatus for electrically charging the photosensitive member uniformly to a predetermined polarity and a predetermined potential (charging step), an exposure apparatus as an information writing means for forming an electrostatic latent image on the electrically charged photosensitive member (exposure step), a developing apparatus for developing the electrostatic latent image formed on the photosensitive member with toner as a developer to form a visualized image as a toner image (developing step), a transfer apparatus for transferring the toner image from a surface of the photosensitive member onto a recording material (transfer material) such as paper (transfer step), a cleaning apparatus for removing toner remaining in some amounts on the photosensitive member after the transfer step (residual developer or transfer residual toner) to clean the photosensitive member surface (cleaning step), and a fixing apparatus for fixing the toner image on the recording material (fixing step). The photosensitive member is repetitively subjected to an electrophotographic process (charging step, exposure step, developing step, transfer step, cleaning step, fixing step) described above to form an image.

For the charging apparatus for the photosensitive member, in recent years, a charging apparatus using a contact charging method is becoming mainstream, in place of a non-contact charging method utilizing a corona discharge phenomenon such as a phenomenon caused by a scorotron charging device. The contact charging method is a method in which an electroconductive charging member (principally, a charging roller using an electroconductive roller) is brought into a direct contact with or in proximity to an image bearing member, such as the photosensitive member, and a charging voltage is applied into the charging member to uniformly charge the image bearing member to a predetermined polarity and a predetermined potential. The contact charging method does not require a large capacity high voltage power source, so that the contact charging method is advantageous in terms of cost reduction and downsizing, and it is possible to suppress an occurrence of ozone in a very small amount compared with the case of the corona charging method.

The toner remaining on the photosensitive member after the transfer step is removed from the surface of the photosensitive member by the cleaning apparatus and collected in the cleaning apparatus as waste toner. However, from the viewpoints of environmental protection and effective use of resources, it is desirable that waste toner is not produced.

In view of this problem, a cleaner-less image forming apparatus wherein a cleaning apparatus is omitted and transfer residual toner on a photosensitive member after a transfer step is removed and collected from the photosensitive member by a developing apparatus through simultaneous development and cleaning is proposed.

In the simultaneous development and cleaning, the transfer residual toner on the photosensitive member after the transfer step is collected in the developing apparatus during a developing step of a subsequent step or later. More specifically, first, the photosensitive member to which the transfer residual toner is attached is further subjected to charging and exposure to light to form an electrostatic latent image.

During the developing step of the electrostatic latent image in this method, transfer residual toner, of the transfer residual toner remaining on the photosensitive member surface, present at a portion (non-image portion) which is not intended to be developed is removed and collected in the developing apparatus by a fog-removing bias. The fog-removing bias is a fog-removing potential difference Vback between a DC voltage applied to the developing apparatus and a surface potential of the photosensitive member.

According to this method, the transfer residual toner is collected in the developing apparatus and utilized again for developing an electrostatic latent image in a subsequent step or later, so that the waste toner can be eliminated and a maintenance operation can also be reduced. Further, in the method, the cleaning apparatus (cleaner) is not used, so that the method is also advantageous for downsizing of the image forming apparatus.

In the cleaner-less image forming apparatus in which the transfer residual toner remaining on the photosensitive member after the transfer step is removed and collected by the developing apparatus, when toner charged to a polarity opposite to a normal charge polarity is present in the transfer residual toner, the toner cannot be removed and collected from the photosensitive member into the developing apparatus. Further, the reversely charged transfer residual toner is carried and moved on the photosensitive member, so that the transfer residual toner can cause a defective image due to improper charging.

The reason why the toner charged to the polarity opposite to the normal charge polarity is generated in the transfer residual toner is that there is the case where a toner component having a charge polarity which has been originally reversed to an opposite polarity is contained in the toner as the developer, although an amount thereof is small. Further, the reason is because even toner having the normal charge polarity can be reversed in charge polarity by the influence of a transfer bias, separating discharge, or the like.

That is, in order to remove and collect the transfer residual toner from the photosensitive member into the developing apparatus, the transfer residual toner passing through a charging portion and reaching a developing portion is required to have the normal charge polarity and a charge amount of toner capable of being collected from the photosensitive member by the developing apparatus.

In Japanese Laid-Open Patent Application (JP-A) 2001-183905, in order to prevent deposition of the reversed charged transfer residual toner to the charging roller and collect the transfer residual toner by the developing apparatus, a developer charge control means for uniformizing the charge polarity of the transfer residual toner on the photosensitive member to the normal charge polarity is provided in contact with the photosensitive member.

In JP-A 2003-295584, in order to facilitate temporary collection of the transfer residual toner at a magnetic brush charging portion, a developer charge control means for electrically discharging the transfer residual toner or electrically charging the transfer residual toner to a polarity opposite to a charge polarity of a photosensitive member is provided in contact with the photosensitive member. The transfer residual toner temporarily collected at the magnetic brush charging portion is entirely changed in charge polarity to a normal charge polarity by the magnetic brush and successively discharged on the photosensitive member, followed by collection thereof by a developing apparatus through simultaneous development and cleaning.

In JP-A 2001-215798 or JP-A 2004-117599, between a transfer portion and a charging portion, auxiliary charging members including a transfer residual toner uniformizing means and a toner charge amount control means are provided in this order with respect to a downstream direction from the transfer portion.

The transfer residual toner uniformizing means is a means for dispersing and distribution an image pattern of an image of the transfer residual toner remaining on the surface of the photosensitive member without being transferred at the transfer portion to remove the image pattern. More specifically, the surface of the photosensitive member is rubbed with a rubbing member such as a brush to scrape or disturb the image pattern of the transfer residual developer so as to disperse or distribute the transfer residual developer on the surface of the photosensitive member.

By disposing the transfer residual toner uniformizing means, it becomes possible to stably perform a process of electrically charging the transfer residual toner on the photosensitive member to a normal charge polarity by the toner charge amount control means in a subsequent step. Further, a latent image pattern of the transfer residual toner image on the photosensitive member is also erased at the same time, so that it is possible to prevent an occurrence of a ghost image of the latent image pattern of the transfer residual toner image.

More specifically, e.g., in the case of an image such as a vertical pattern image less transferred at the transfer portion, an amount of the transfer residual toner on the photosensitive member is locally increased. In such a case, when the transfer residual toner uniformizing means is not provided, the transfer residual toner is conveyed to the toner charge amount control means without being dispersed uniformly. For this reason, the transfer residual toner cannot be sufficiently processed by the toner charge amount control means so as to be electrically charged to the normal charge polarity. As a result, a ghost image can be caused to occur on a subsequent image by a pattern of the transfer residual toner i.e., a latent image pattern remaining on the photosensitive member after the transfer step.

The pattern of the transfer residual toner on the photosensitive member conveyed to the toner charge amount control means is sufficiently removed by providing the transfer residual toner uniformizing means, so that it becomes possible to process the transfer residual toner so as to be electrically charged by the toner charge amount control means to have a charge amount suitable for collection by the developing apparatus. As a result, it is possible to effectively collect the transfer residual toner by the developing apparatus, so that a stable image free from charging failure, ghost, fog, and the like caused by carrying and moving the transfer residual toner on the photosensitive member can be obtained.

However, in the case where a printing operation of an image having a high print ratio, such as a photographic image, is performed, a part of the transfer residual toner is deposited and accumulated at the contact portions of the photosensitive member with the auxiliary charging means, such as the developing charge control means, the transfer residual toner uniformizing means, and the toner charge amount control means. As a result, electrical resistances of the contact portions between the photosensitive member and these means are increased, thus causing a lowering in function of these means, so that the pattern removal of the transfer residual toner and the charging process of the transfer residual toner become insufficient. Further, such a problem that the reversely charged toner cannot be completely collected by the developing apparatus and is carried and moved on the photosensitive member arises.

Particularly, in the image forming apparatus employing the cleaner-less system, when the transfer residual toner is carried and moved on the photosensitive member, the surface potential of the photosensitive member cannot be changed to a desired value. As a result, there is a possibility that the transfer residual toner induces new fog in the developing apparatus, thus resulting in a vicious cycle. Therefore, collection of the reversely charged toner can be considered. For example, JP-A 2004-191766 discloses a constitution, for collecting the reversely charged toner, in which the reversely charged toner is collected by the developing apparatus by discharging the reversely charged toner on the charging roller during post-rotation of after completion of image formation thereby to increase an absolute value of a developing bias so as to be higher than that of a drum surface potential. However, in order to collect the reversely charged toner, an increase in absolute value of the developing bias compared with the drum surface potential can be considered. However, in this case, the normal toner supplied from the developing apparatus is subjected to development, so that the toner is consumed unnecessarily.

SUMMARY OF THE INVENTION

The present invention has accomplished in view of the above-described problems in an image forming apparatus using a cleaner-less system for collecting transfer residual toner by a developing apparatus.

A principal object of the present invention is to provide an image forming apparatus capable of reducing an occurrence of fog and the like caused by carrying and moving reversely charged toner with no collection by a developing apparatus while minimizing unnecessary consumption of normal toner.

According to an aspect of the present invention, there is provided an image forming apparatus comprising:

an image bearing member for bearing a toner image;

charging means for electrically charging the image bearing member;

latent image forming means for forming an electrostatic latent image on the image bearing member electrically charged by the charging means;

developing means for developing the latent image into a toner image and collecting residual toner remaining on the image bearing member after a previous image forming process;

transfer means for transferring the toner image onto a transfer medium; and charge control means for controlling a charging condition of the charging means so that, after the image bearing member is electrically charged by the charging member, a potential difference between a first surface potential of the image bearing member at a portion under the residual toner and a second surface potential of the image bearing member at a portion free from the residual toner during non-image formation is larger than that during image formation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
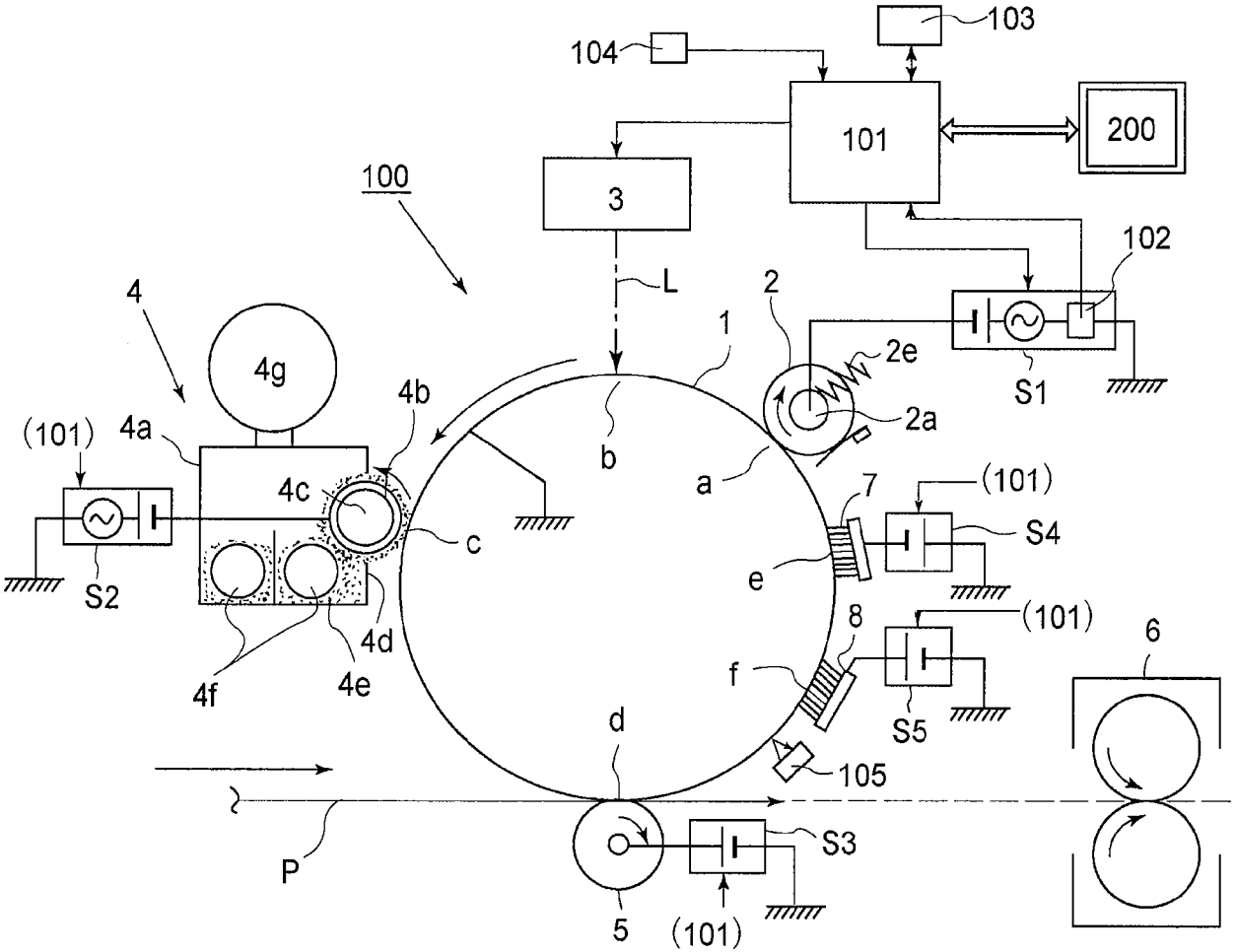
FIG. 1 is a schematic structural view of a major portion of an image forming apparatus in an embodiment of the present invention.

Hereinbelow, the image forming apparatuses according to the present invention will be described more specifically with reference to the drawing.

FIG. 1 is a schematic structural view of an embodiment of the image forming apparatus in accordance with the present invention. An image forming apparatus 100 of this embodiment is an electrophotographic laser beam printer employing a contact charging method, a reverse developing method, and a cleaner-less method (system).

<General Structure of Printer>

First, the general structure of the printer 100 of this embodiment will be described with reference to FIG. 1.

(a) Image Bearing Member

The printer 100 includes as an image bearing member, an electrophotographic photosensitive member 1 in the form of a rotational drum (hereinafter, simply referred to as "drum"). In this embodiment, the drum 1 is a negatively chargeable organic photoconductor (OPC) and has an outer diameter of 60 mm. The drum 1 is rotationally driven about the axial line of the photosensitive drum supporting shaft (not shown) at a process speed (peripheral speed) of 100 mm/sec in a counter-clockwise direction indicated by an arrow.

Figure 2:
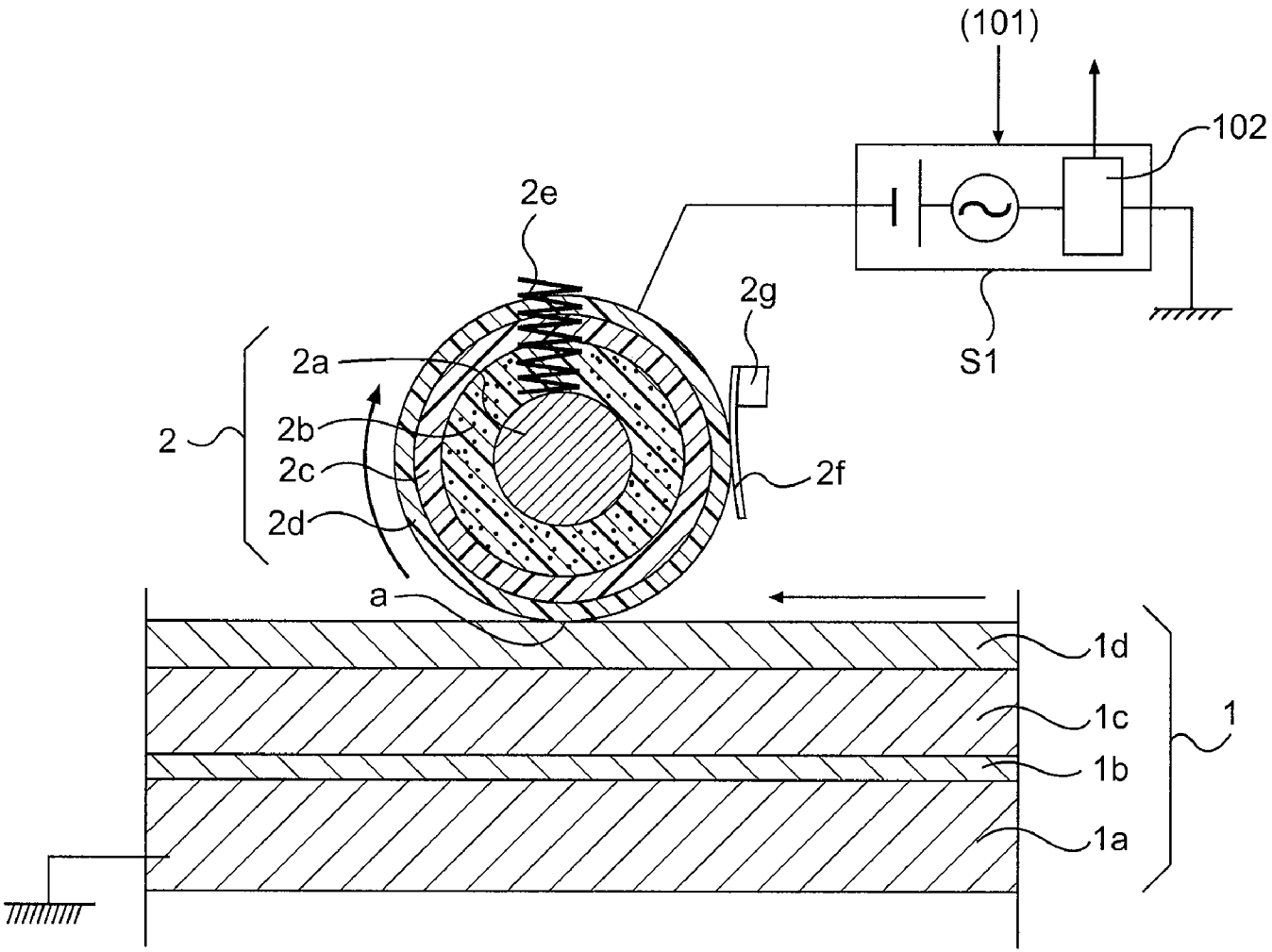
FIG. 2 is a schematic view showing layer structures of a photosensitive member and a charging roller and a power source in the image forming apparatus.

Referring to FIG. 2, which schematically shows a layer structure of the drum 1, the drum 1 includes an aluminum cylinder 1*a* (electrically conductive drum support), and three functional layers coated in layers on a surface of the aluminum cylinder 1*a*. The three layers are an undercoat layer 1*b*, a photocharge generating layer 1*c*, and a charge transport layer 1*d*, dispersed in this order on the aluminum cylinder 1*a*. The undercoat layer 1*b* is provided for suppressing optical interferences and improving the adhesive properties of the layer thereupon to the aluminum cylinder 1*a*.

(b) Charging Means

The printer 100 includes a charging means 2 for uniformly charging the peripheral surface of the drum 1. In this embodiment, the charging means 2 is an electroconductive elastic roller (hereinafter, referred to as "charging roller").

This charging roller 2 is disposed in parallel with the axial line direction of the drum 1. Both end portions of a core metal 2*a* of the charging roller 2 is rotatably supported by unshown bearing member, and the charging roller 2 is urged against the drum 1 by pressing springs 2*e*. As a result, the charging roller 2 is pressed against the drum 1 at a predetermined pressing force. The charging roller 2 is rotated by the rotation of the drum 1. The contact portion between the drum 1 and charging roller 2 constitutes a charging portion (charging nip) a.

To the metal core 2*a* of the charging roller 2, a charging bias voltage is applied from an electrical power source (supply) S1 under a predetermined condition. As a result, the peripheral surface of the drum 1 is electrically charged to a predetermined polarity and a predetermined potential. In this embodiment, the charging bias voltage applied to the charging roller 2 is an oscillating voltage in the form of a DC voltage (Vdc) biased with AC voltage (Vac). More specifically, it is an oscillating voltage in the form of a DC voltage (Vdc) of −600 V biased with an AC voltage (Vac), which is 1.3 kHz and 1.5 kV in frequency f and peak-to-peak voltage Vpp obtained by control described later, respectively, and has a sinusoidal waveform. By this oscillating voltage, the peripheral surface of the drum 1 is uniformly charged to −600 V (dark part potential Vd) identical to the DC voltage applied to the charging roller 2.

In the case where the peak-to-peak voltage applied to the charging roller 2 is unnecessarily increased, excessive discharge (discharge current) occurs between the charging roller 2 and the drum 1, so that an electric charge product deposits on the drum 1. In an image forming apparatus in which a cleaning member such as a rubber blade is provided to the drum 1, the charge product is removed by the cleaning blade. However, in the image forming apparatus employing the cleaner-less system, the charge product on the drum cannot be removed. For this reason, the applied voltage is required to be suppressed so that it is a minimum peak-to-peak voltage (discharge current) required for uniformly charging the drum surface.

Figure 7:
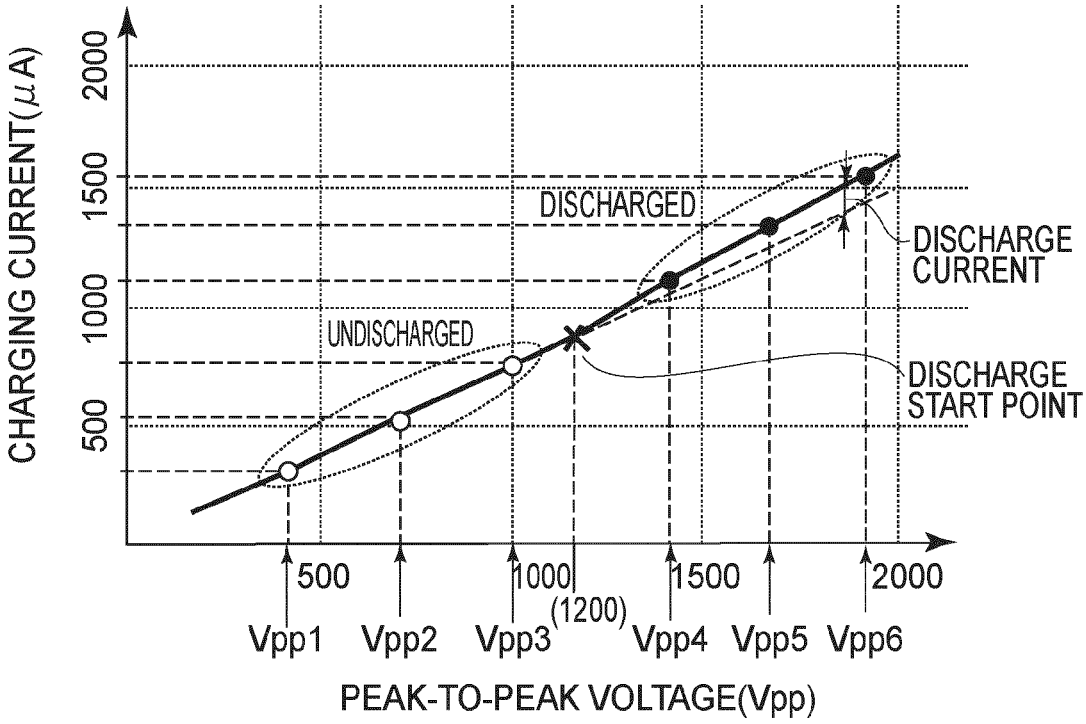
FIG. 7 is a graph showing a relationship between a current and a peak-to-peak voltage of a charging AC voltage.

In the printer 100 in this embodiment, the following control is carried out. Specifically, a control circuit (CPU) 101 of the printer controls a power source S1 during pre-print rotation operation (FIG. 4) to apply successively 6 peak-to-peak voltages Vpp1 to Vpp6, shown in FIG. 7, to the charging roller 2. The peak-to-peak voltages Vpp4, Vpp5, and Vpp6 are three peak-to-peak voltages in an electrically discharged area and satisfy Vpp4<Vpp5<Vpp6. The peak-to-peak voltages Vpp1, Vpp2, and Vpp3 and three peak-to-peak voltages in an electrically undischarged area and satisfy Vpp1<Vpp2<Vpp3.

In this case, a value of AC current (an amount of charging AC current) passing through the charging roller 2 through the drum 1 is measured by an AC current measuring circuit 102 contained in the power source S1 and is inputted into the control circuit 101.

The control circuit 101 makes collinear approximation of a relationship between the peak-to-peak voltage and the AC current in each of the discharged area and the undischarged area from associated measured current values at three printhead points by using the method of least squares.

Here, a point of intersection of two approximate curves in the discharged area and the undischarged area is discharge start peak-to-peak voltage for starting discharge between the charging roller 2 and the drum 1 and a difference between two approximate curves in the discharged area is a discharge current.

Figure 8:
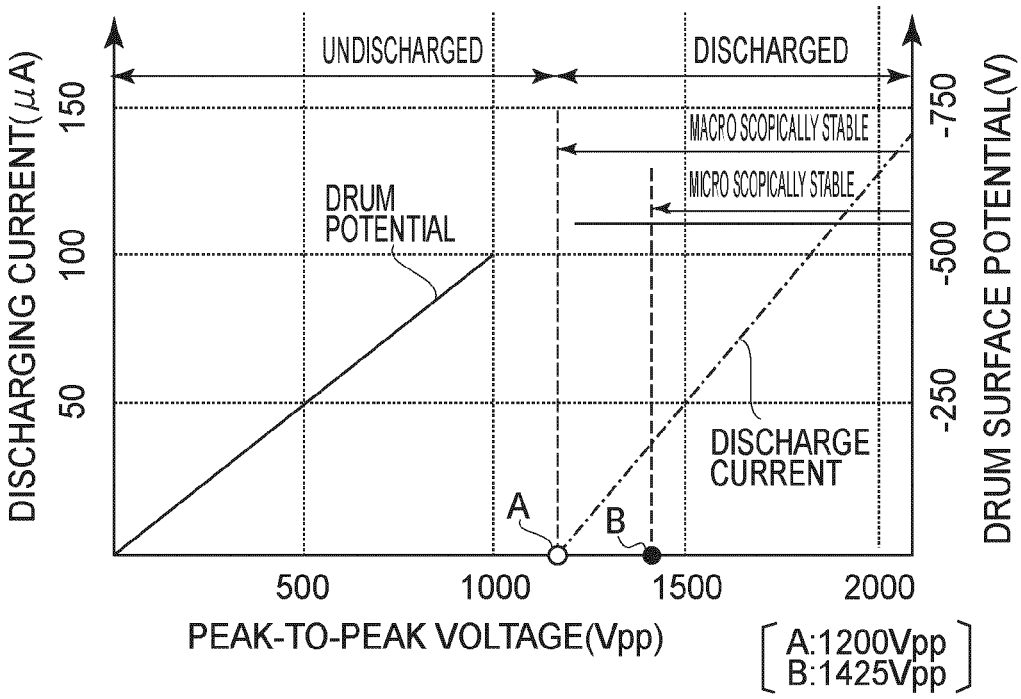
FIG. 8 is a graph showing a relationship between a peak-to-peak voltage of a charging AC voltage and a discharging current or a surface potential of a photosensitive drum.

FIG. 8 shows a relationship between the peak-to-peak voltage and the discharge current and a relationship between the peak-to-peak voltage and a drum surface potential at the time of applying a DC voltage of −600 V to the charging roller 2. From the latter relationship, it is found that the surface of the drum 1 is electrically charged to a surface potential of about −600 V when an AC voltage of not less than the discharge start peak-to-peak voltage (point A in FIG. 8; 1200 Vpp) (macroscopically stable potential area).

However, at a peak-to-peak voltage less than and close to the discharge start peak-to-peak voltage, the surface of the drum 1 cannot be sufficiently charged uniformly, so that fog due to locally improper charging (so-called sandpaper like fog) is caused to occur.

In order to solve such a problem, it is necessary to generate discharge (discharge current) in an amount of not less than a certain value. In this embodiment, in an ambient environment of an ambient temperature of 23° C. and an ambient humidity of 50% RH, it is possible to uniformize the drum surface potential by providing a discharge current of 40 μA (target discharge current) or more (microscopically stable potential area).

The target discharge current varies depending on an ambient environment in which the printer 100 is used and is decreased with a higher humidity environment.

By performing the above-described control, in FIG. 8, a peak-to-peak voltage providing the target discharge current (minimum discharge current) of 40 μA is calculated as 1425 Vpp (point B in FIG. 8).

The charging roller 2 is 300 mm in longitudinal length and, as shown in FIG. 2 which is a layer structure diagram of the charging roller 2, includes the metal core (supporting member) 2*a* and laminated three layers of an undercoat layer 2*b*, an intermediary layer 2*c*, and a surface layer 2*d*, which are disposed in this order on the peripheral surface of the metal core 2*a*. The undercoat layer 2*b* is a foamed sponge layer for reducing charging noises, and the surface layer 2*d* is a protective layer provided for preventing electrical leak even when the drum 1 has defects such as pin holes at its surface.

More specifically, the specification of the charging roller 2 in this embodiment is as follows:

a. metal core 2*a*: a stainless steel rod with a diameter of 6 mm;

b. undercoat layer 2*b*: formed of foamed EPDM in which carbon black has been dispersed; 0.5 g/cm$^3$ in specific gravity; $10^2$-$10^9$ ohm.cm in volume resistivity; 3.0 mm in thickness; and 320 mm in length;

c: intermediary layer 2*c*: formed of NBR in which carbon black has been dispersed; $10^2$-$10^5$ ohm.cm in volume resistivity; and 700 μm in thickness; and d. surface layer 2*d*: formed of Toresin resin, which is a fluorinated compound, in which tin oxide and carbon black have been dispersed; $10^7$-$10^{10}$ ohm.cm in volume resistivity; 1.5 μm in surface roughness (10 point average surface roughness Ra in JIS); and 10 μm in thickness.

Referring to FIG. 2, reference numeral 2*f* represents a charging roller cleaning member. In this embodiment, the charging roller cleaning member is a flexible cleaning film of polyimide. This cleaning film 2*f* is disposed in parallel to the longitudinal direction of the charging roller 2, and is fixed, at one end thereof, to a supporting member 2*g* which reciprocates in a certain amount in the longitudinal direction of the charge roller 2. Further, the cleaning film 2*f* is disposed so that its surface close to its free edge forms a contact nip with the peripheral surface of the charging roller 2. The supporting member 2*g* is driven by a driving motor (not shown) of the printer 100 through a gear train so that it reciprocates in the certain amount in its longitudinal direction. As a result, the surface layer 2*d* of the charging roller 2 is rubbed by the cleaning film 2*f*. By this action of the cleaning film 2*f*, contaminants (fine toner particles, additives, and the like) deposited on the surface of the charging roller 2 are removed.

(c) Information Writing Means (Latent Image Forming Means)

The printer 100 includes an information writing means 3 for forming an electrostatic latent image on the surface of the charged drum 1. In this embodiment, the information writing means as the latent image forming means is a laser beam scanner (exposing apparatus) employing a semiconductor laser. The laser beam scanner 3 outputs a laser beam L modulated corresponding to an image signal sent to the control circuit 101 of the printer 100 from a host apparatus 200 such as a personal computer or an image reader. With this outputted layer beam L, the surface of the drum 1 which has been uniformly charged and rotated is subjected to scanning exposure (image exposure) at an exposing position (exposing portion). By this laser beam scanning a potential of the drum surface at a position at which the surface of the drum 1 is irradiated with the laser beam L is reduced. As a result, an electrostatic latent image corresponding to the image information is successively formed on the peripheral surface of the drum 1.

(d) Developing Means

The printer 100 includes a developing means 4 for reversely developing the electrostatic latent image on the drum 1 into a toner image (developer image) by supplying toner in accordance with the electrostatic latent image.

In this embodiment, the developing means 4 is a reversal developing apparatus employing a two-component contact developing method in which the development is performed by bringing a magnetic brush of a two component developer comprising the toner and a carrier into contact with the drum 1.

Figure 3:
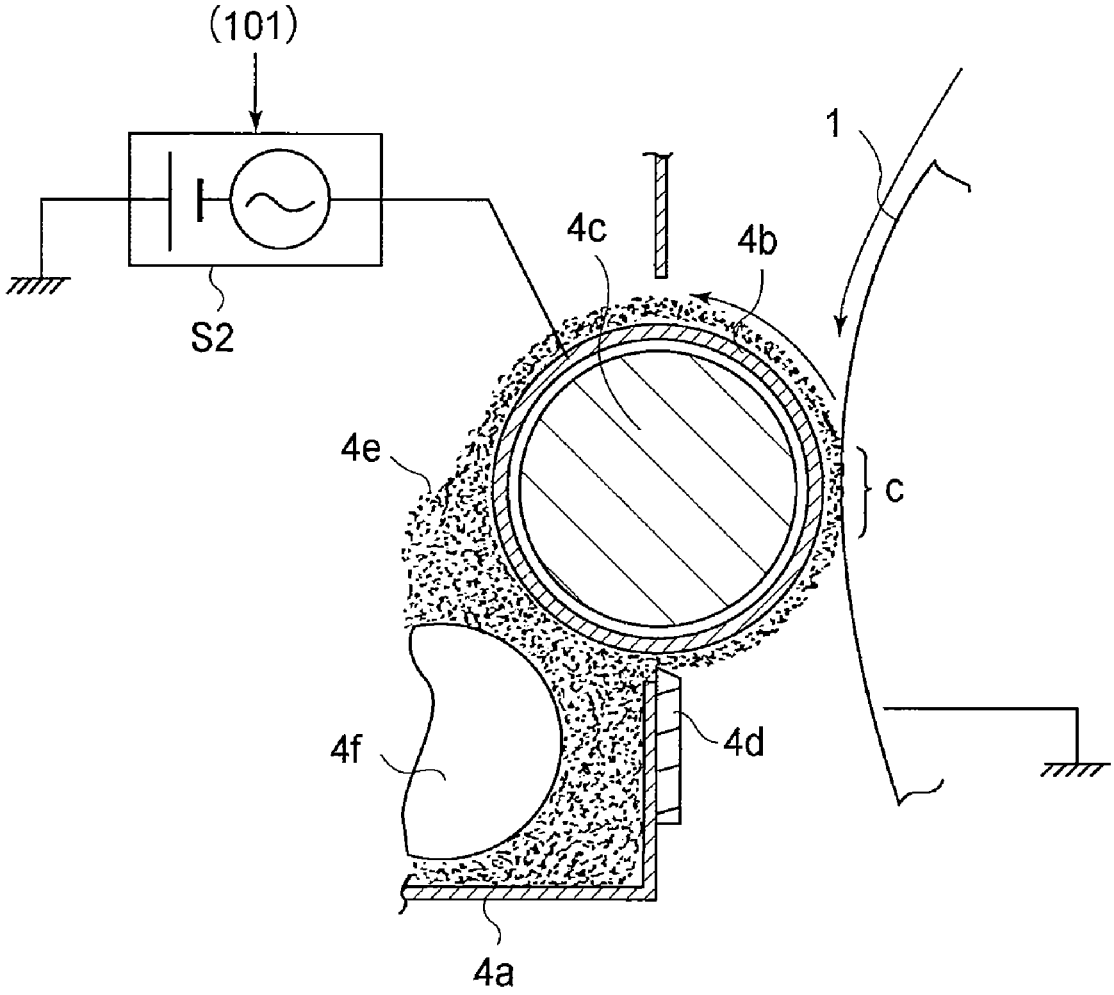
FIG. 3 is a schematic view showing a major portion of a developing apparatus of the image forming apparatus.

Referring to FIGS. 1 and 3, the developing apparatus 4 includes a developing container 4*a* and a non-magnetic developing sleeve 4*b* as a developer carrying member. The developing sleeve 4*b* is rotatably disposed within the developing container 4*a* with its outer peripheral surface partially exposed to the outside of the developing apparatus 4. Inside the developing sleeve 4*b*, a magnetic roller 4*c* is non-rotationally fixed and inserted into the developing sleeve 4*b*. A developer coating blade 4*d* is disposed opposite to the developing sleeve 4*b*. A two-component developer 4*e* is accommodated in the developing container 4*a*. Developer stirring and conveying members 4*f* are disposed at the bottom of the developing container 4*a*. A toner hopper 4*g* contains replenishment toner.

The two-component developer 4*e* in the developing container 4*a* is a mixture of non-magnetic toner and a magnetic carrier, and is conveyed while being stirred by the developer stirring and conveying members 4*f*. The toner is negatively charged triboelectrically by the friction with the magnetic carrier. That is, in this embodiment, the toner is triboelectrically charged to a negative polarity identical to the charge polarity of the drum 1. In this embodiment, the magnetic carrier has an electrical resistance of $10^{13}$ ohm.cm and a volume-average particle size of 40 μm.

The developing sleeve 4*b* is disposed close and opposite to the drum 1 so that the shortest distance (S-D gap) with the drum 1 is kept at 350 μm. The developing sleeve 4*b* is rotationally driven in a direction opposite from a rotational direction of the drum 1 at an opposing portion with respect to the drum 1. A part of the two-component developer 4*e* in the developing container 4*a* is adsorbed and held at the outer peripheral surface of the developing sleeve 4*b* as a magnetic brush layer. The magnetic brush layer is rotationally conveyed by the rotation of the developing sleeve 4*b*. Then, the magnetic brush layer is regulated in thickness by the developer coating blade 4*d* so as to be a predetermined thin layer and contacts and properly rubs the surface of the drum 1 at the opposing portion with the drum 1. A contact portion between the magnetic brush layer of the developer and the drum 1 constitutes a developing portion (developing nip) c.

To the developing sleeve 4*b*, a predetermined developing bias voltage is applied from a power source S2. In this embodiment, the developing bias voltage applied to the developing sleeve 4*b* is an oscillating voltage in the form of a DC voltage (Vdc) biased with an AC voltage (Vac). More specifically, it is an oscillating voltage consisting of a DC voltage (Vdc) of −450 V biased with a rectangular AC voltage (Vac) which is 8.0 kHz and 1.8 kV in frequency and peak-to-peak voltage Vpp, respectively.

Then, the toner in the developer 4*e* conveyed to the developing portion c is selectively attached to the surface of the drum 1 corresponding to the electrostatic latent image by the electrical field generated by the development bias voltage. As a result, the electrostatic latent image is developed into a toner image. In this embodiment, the electrostatic latent image is reversely developed by attaching the toner to an exposed light portion at the surface of the drum 1.

The thin layer of the developer on the developing sleeve 4*b*, which has passed through the developing portion c, is conveyed back into a developer storing portion in the developer container 4*a*.

In order to keep a toner concentration of the two-component developer 4*e* in the developing container 4*a* within a substantially certain range, the toner concentration of the two-component developer 4*e* in the developing container 4*a* is detected by, for example, an optical toner concentration sensor (not shown). The control circuit (control means) 101 drives and controls the toner hopper 4*g* depending on the detected information, so that the toner in the toner hopper 4*g* is supplied to the two-component developer 4*e* in the developer container 4*a*. The toner supplied to the two-component developer 4*e* is stuffed by the stirring and conveying members 4*f*.

(e) Transfer Means and Fixing Means

The printer 100 includes a transfer apparatus 5 as a transfer means. In this embodiment, the transfer apparatus 5 is a transfer roller. The transfer roller 5 is pressed against the drum 1 at a predetermined pressing force. The resultant press contact nip constitutes a transfer portion (transfer nip) d. To this transfer portion d, a recording material P as a transfer medium is conveyed from a sheet feeding mechanism (not shown) at predetermined control timing.

The recording material P conveyed to the transfer portion d is nipped and conveyed between the rotating drum 1 and the transfer roller 5. During the conveyance, a transfer bias voltage of a positive polarity, which is +2 kV in this embodiment opposite to the negative (normal) charge polarity of the toner, is applied to the transfer roller 5 from a power source S3. As a result, the toner image on the peripheral surface of the photosensitive drum 1 is transferred, electrostatically and sequentially, onto the surface of the recording material P which is nipped and conveyed through the transfer portion d. In this embodiment, the recording material P is described as the transfer medium but it is also possible to employ a constitution in which the toner is transferred onto the recording material P though an intermediary transfer member as the transfer medium.

The recording material P subjected to the toner image transfer while passing through the transfer portion d is successively separated from the surface of the drum 1 and is conveyed to the fixing apparatus 6. In this embodiment, the fixing apparatus 6 is a heat roller type fixing apparatus. The recording material P is subjected to fixation of the toner image by the fixing apparatus 6 and is outputted as an image-formed product (print or copy).

(f) Cleaner-Less System

The printer 100 in this embodiment is of a so-called cleaner-less type. In other words, the printer 100 is not equipped with a cleaning apparatus dedicated to the removal of the transfer residual toner remaining in some amount on the surface of the drum 1 after the transfer of the toner image onto the recording material P.

After the transfer, the transfer residual toner on the surface of the drum 1 is conveyed by further rotation of the drum 1 through the charging portion a and exposing portion b to the developing portion c, at which the transfer residual toner removed and collected by the developing apparatus 4 through the simultaneous development and cleaning (cleaner-less system). In other words, the developing apparatus 4 as the developing means has the function of not only developing the latent image formed on the drum 1 into the toner image but also collecting the transfer residual toner remaining after the previous image forming process.

In this embodiment, the developing sleeve 4*b* of the developing apparatus 4 is, as described above, rotated in the direction opposite from the movement direction of the surface of the drum 1 at the developing portion c. Such a rotation of the developing sleeve 4*b* is advantageous for the constitution of the transfer residual toner on the surface of the drum 1.

Since the transfer residual toner on the surface of the drum 1 passes through the exposing station b, the exposing step is performed with the presence of the transfer residual toner particles on the drum surface.

However, the amount of the transfer residual toner is ordinarily small, so that great influence by performing the exposing process with the presence of the transfer residual toner does not appear.

However, as described above, in order to effectively perform simultaneous development and cleaning of the transfer residual toner on the surface of the drum 1 by the developing apparatus 4, it is necessary that the transfer residual toner on the drum 1, which is being conveyed to the developing portion c, is normal in charge polarity, and that the amount of the electric charge of the transfer residual toner is sufficient to develop the electrostatic latent image on the drum 1 by the developing apparatus 4. The reversely charged toner cannot be removed and constituted from the drum 1 to the developing apparatus 4, thus causing a defective image.

For this reason, the transfer residual toner uniformizing means 8 as the auxiliary charging means for uniformizing the transfer residual toner on the drum 1 is disposed at a position downstream from the transfer portion d with respect to the rotational direction of the drum 1. Further, and the toner charge amount control means (developer charge amount control means) 7 as the auxiliary charging means for electrically uniformly charging the transfer residual toner to the negative polarity as the normal charge polarity is disposed at a position downstream from the transfer residual toner uniformizing means 8 and upstream from the charging portion a with respect to the rotation direction of the photosensitive drum 1.

Generally, the transfer residual toner remaining on the drum 1 without being transferred onto the transfer material P at the transfer portion d contains the reversely charged toner and the improperly charged toner in mixture.

The transfer residual toner is once charge-removed by the transfer residual toner uniformizing means 8 and then electrically charged again to the normal charge polarity by the toner charge amount control means 7. Therefore, it is possible to effectively prevent the deposition of the transfer residual toner to the charging roller 2 and removal and collection of the transfer residual toner by the developing apparatus 4 can be performed completely, so that it is possible to strictly prevent an occurrence of ghost image of the transfer residual toner image pattern.

In this embodiment, the transfer residual toner uniformizing means 8 and the toner charge amount control means 7 are brush-like members with an appropriate electroconductivity. The transfer residual toner uniformizing means 8 forms a contact portion f with the surface of the drum 1. The toner charge amount control means 7 from a contact portion e with the surface of the drum 1. The brush-like member is prepared by dispersing a resistance-adjusting agent such as carbon black or metal powder in fibers of rayon, acryl resin, polyester, or the like to have an adjusted electrical resistance. The brush-like member may preferably be formed of fibers each having a thickness (fineness) of not more than 30 denier per fiber and has a planted density of 7750-77500 fibers/cm$^2$ ($5\times10^4$-$5\times10^5$ fibers/inch$^2$). A specific brush-like member used in this embodiment has a thickness of 6 denier per fiber, a planted density of 15500 fibers/cm$^2$ ($10\times10^4$ fibers/inch$^2$), a length from fixed end to free end of 5 mm, and an electrical resistance of $5\times10^4$ ohm.cm.

Each of a width of the contact portion f formed between the transfer residual toner uniformizing means 8 and the drum 1 and a width of the contact portion e formed between the toner charge amount control means 7 and the drum 1 with respect to a sub-scanning direction (drum rotational direction) is 5 mm. Further, the transfer residual toner uniformizing means 8 and the toner charge amount control means 7 are pressed against the surface of the drum 1 with a penetration depth of 1 mm. Further, the transfer residual toner uniformizing means 8 and the toner charge amount control means 7 are caused to perform reciprocating motion with an amplitude of 2.5 mm and a frequency of 2.0 Hz with respect to a main scanning direction (drum axial direction) of the surface of the drum 1.

To the transfer residual toner uniformizing means 8, a DC voltage of the positive polarity opposite to the polarity of the DC voltage applied to the charging roller 2 is applied from a power source S5. To the toner charge amount control means 7, a DC voltage of the negative polarity identical to that of the DC voltage applied to the charging roller 2 is applied from a power source S4. More specifically, a DC voltage of +300 V is variably applied to the transfer residual toner uniformizing means 8 and a voltage of −700 V is applied to the toner charge amount control means 7.

The transfer residual toner remaining on the photosensitive drum 1 at the transfer portion d after the toner image is transferred onto the transfer material P reaches the contact portion f between the transfer residual toner uniformizing means 8 and the drum 1, where the amount of the electric charge of the transfer residual toner is uniformized by the transfer residual toner uniformizing means 8. Then, the transfer residual toner uniformized by the transfer residual toner uniformizing means 8 on the surface of the drum 1 reaches the contact portion e between the toner charge amount control means 7 and the drum 1, where the charge polarity of the transfer residual toner is controlled by the toner charge amount control means 7 so as to be a uniformly negative polarity as the normal charge polarity.

Next, the collection of the transfer residual toner in the developing step will be described.

The developing apparatus 4, as described above, employs the cleaner-less method in which it cleans the drum surface and collects the transfer residual toner simultaneously with the development.

In order to collect the transfer residual toner on the drum 1 into the developing apparatus 4, the charge amount of the toner is required to be substantially equal to that during the development. As described above, when a proper amount of the transfer residual toner is present, the charge amount of the transfer residual toner can be controlled by the toner charge amount control means 7. Further, the charge amount of the transfer residual toner electrically charged to the negative (normal) polarity by the toner charge amount control means 7 is controlled to be an appropriate charge amount for permitting development of the electrostatic latent image on the drum 1 by the developing apparatus 4, so that the collection of the transfer residual toner by the developing apparatus 4 is efficiently performed.

(g) Printer Operation Sequence

Figure 4:
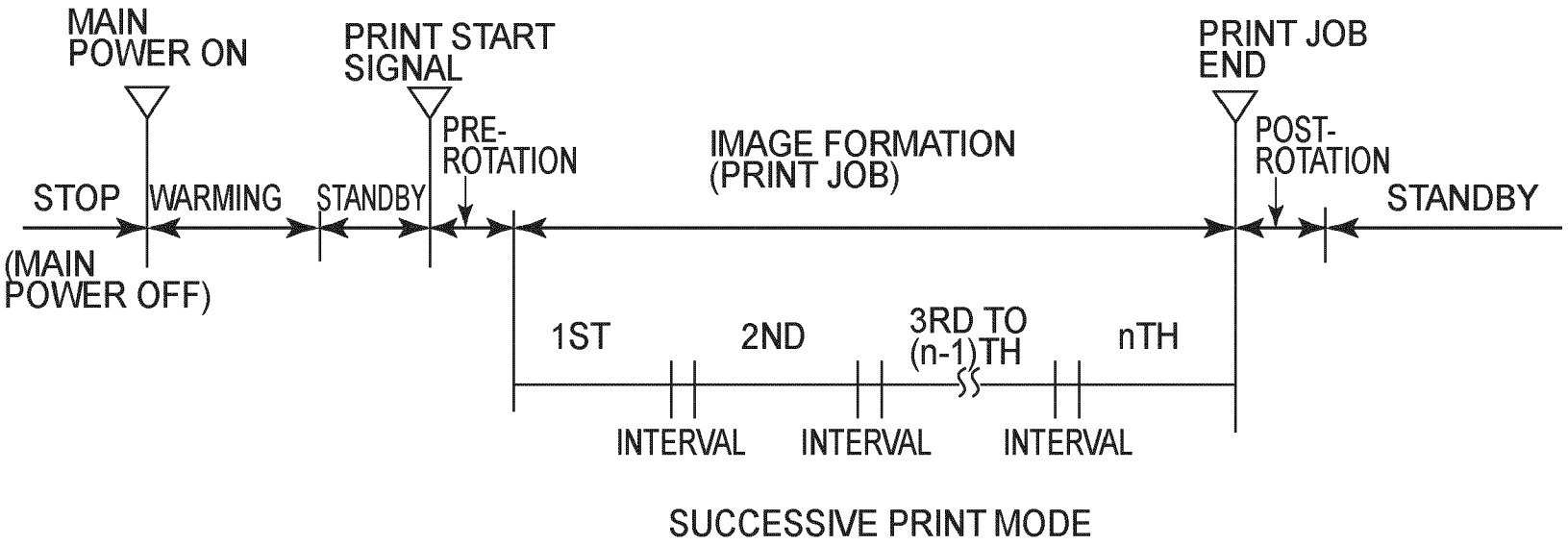
FIG. 4 is an operation sequence diagram of the image forming apparatus.

Next, an operation sequence of the above-described printer will be described with reference to FIG. 4. The printer 100, as described above, forms an image, corresponding to electrical image information inputted from the host apparatus 200 connected to the control circuit 101, on the recording material P and outputs the image. The control circuit 101 gives and receives various electrical information signals with respect to the host apparatus 200. Further, the control circuit 101 manages processing of electrical information signals inputted from various process equipment and sensors at the image forming mechanism portion and various command signals to various process equipment and control of pre-determined image forming sequence. The control circuit 101 executes the control in accordance with a control program stored in a storing apparatus (ROM or RAM) 103 or a look-up table.

A. Warming Operation (Multiple Pre-Rotation Step)

This operation is performed in a starting operation period (actuation operation period) of the printer 100. A main power switch (not shown) of the printer 100 is turned on to actuate a driving motor (not shown) of the printer 100, thereby to rotate the drum 1. Further, warming of predetermined process equipment is performed. The driving motor drives a driving system such as the drum 1, the sheet feeding mechanism portion, the recording material conveying mechanism portion, the developing apparatus 4, the transfer roller 5, or the fixing apparatus 6.

B. Pre-Print Rotation Operation (Pre-Rotation Step)

This operation is performed in a period for executing a pre-operation for printing when a print start signal is inputted. An image formation preparation operation by various process equipment is performed. Principally, preliminary charging of the drum 1, start-up of the laser scanner 3, determination of peak-to-peak voltages Vpp of the AC voltage for the charging bias, determination of the transfer bias, temperature adjustment of the fixing apparatus 6, and the like are performed.

The pre-print rotation operation is performed in succession to the warming operation when the print start signal is inputted during the warming operation. When the print start signal is not inputted, the drive of the driving motor is once stopped after the warming operation is completed, thereby to stop the rotation of the drum 1. The printer 100 is placed in a stand-by state until the print start signal is inputted. When the print start signal is inputted, the pre-rotation step is carried out.

C. Image Forming Operation

When the predetermined pre-print rotation operation is completed, an image forming operation (print job) is started. In the image forming operation, sheet-feeding of the recording material P at predetermined timing, uniform electrical charging of the drum surface by the charging roller 2, image-wise exposure to light L for forming the electrostatic latent image on the drum 1, the development with the toner, etc., are carried out. That is, the image forming process with respect to the surface of the drum 1 is executed and the toner image is transferred onto the recording material P and fixed by the fixing apparatus 6, followed by print-out of the image-formed product.

In the case of a continuous print mode, the above described image forming operation is repetitively performed for a predetermined set print number.

D. Sheet Interval

This is a non-sheet-passing state period, at the transfer nip d, during which a trailing end of a preceding recording material passes through the transfer nip d and then a leading end of a current recording material (subsequent to the preceding recording material) reaches the transfer nip d, in a continuous print mode.

E. Post-Processing Operation (Post-Rotation Step)

This operation is performed in a period in which a predetermined post-processing operation is carried out by continuing the drive of the driving motor for a time to rotate the drum 1 even after a final print job is completed.

E. Stand-By Step

After the post-processing operation is completed, the drive of the driving motor is stopped, thereby to stop the rotation of the drum 1. The printer 100 is placed in a stand-by state until a next print start signal is inputted.

In the case of a single print mode, after the print operation therefor is completed, the printer 100 is placed in the stand-by state through the post-processing operation. Thereafter, when the print start signal is inputted, the printer 100 goes to the pre-print rotation operation.

In the above-described printer operation sequence, the periods for the warning operation, the pre-print operation, the post-processing operation, and the sheet interval in the continuous print mode are non-image formation periods.

<Reversely Charged Toner Collecting Sequence>

As described above, in the transfer residual toner on the surface of the drum 1, the reversely charged toner electrically charged to the polarity opposite to the normal charge polarity is contained and is carried and moved on the surface of the drum 1 without being removed and collected by the developing apparatus 4 through the simultaneous development and cleaning.

The toner carried and moved on the drum surface is increased in amount with an increasing print number to cover the drum surface, so that the surface of the drum 1 cannot be electrically charged to a desired potential to cause improper charging, thus leading to a defective image such as fog.

This phenomenon is noticeable with an increase in an amount of usage of the printer, more specifically an amount of usage of the developer accommodated in the developing apparatus 4. This is because an electric charge imparting ability of the magnetic carrier in the developer with respect to the toner is lowered with the amount of usage of the developer, so that supplied toner cannot be sufficiently charged to have a desired amount of electric charge with the normal charge polarity.

In order to solve this problem, in this embodiment, the reversely charged toner carried and moved on the drum surface is collected in the developing apparatus 4 or a filter at arbitrary timing during the image formation of the printer 100. Then, a "reversely charged toner collection control" sequence in which the reversely charged toner is sufficiently stuffed together with the magnetic carrier again the developer to have a desired positive-polarity charge amount is executed.

In this embodiment, the reversely charged toner collection control sequence is carried out during intervals of continuous image formation (so-called sheet intervals).

Figure 5:
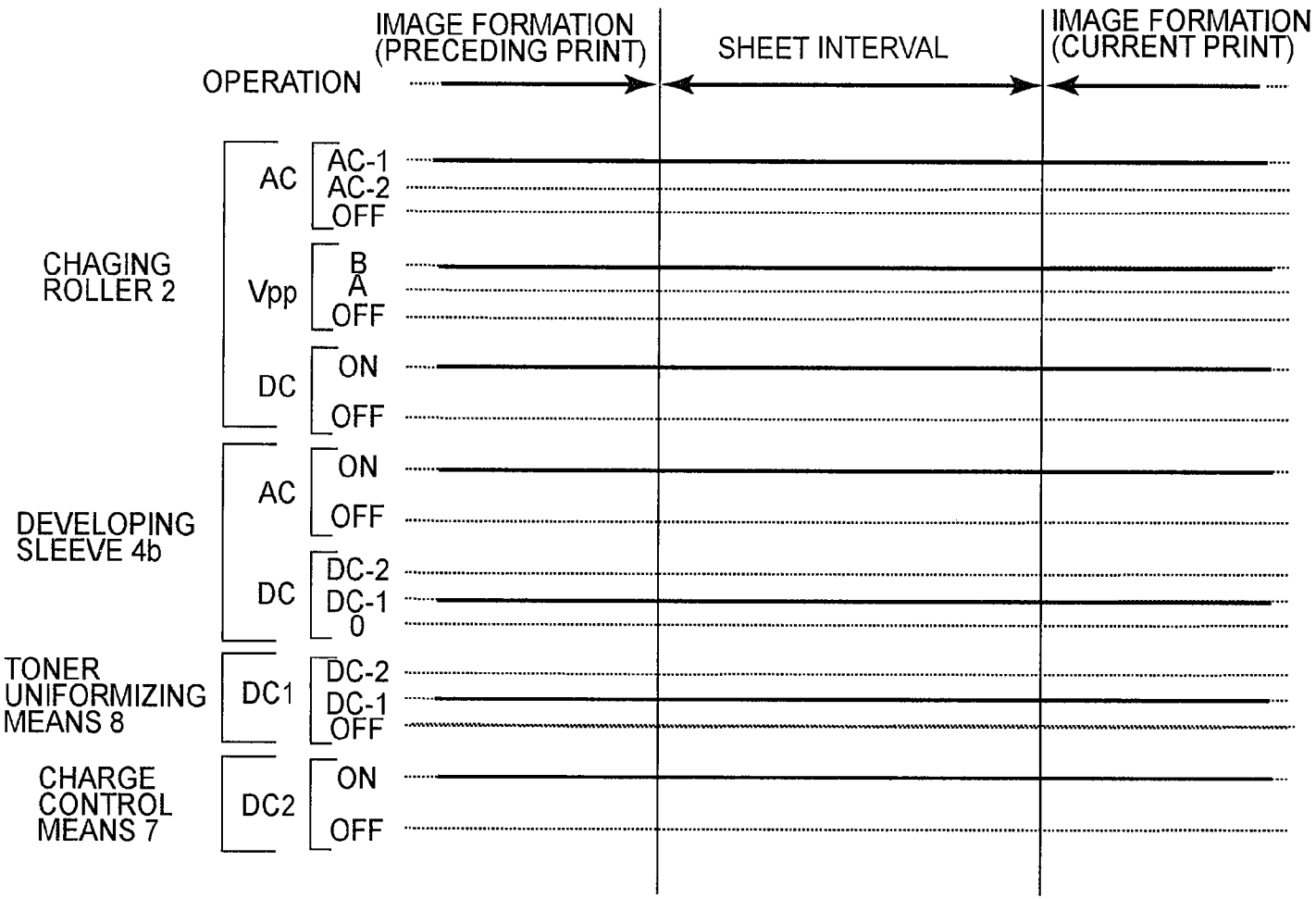
FIG. 5 is a time chart of conventional sheet interval control.

FIG. 5 is a time chart of sheet interval control in a conventional image forming apparatus.

The AC voltages (charging AC and peak-to-peak voltage Vpp) and the DC voltage (charging DC) applied to the charging roller 2 are identical and are not changed with respect to both of the image formation and the sheet interval.

The AC voltage (developing AC) and the DC voltage (developing DC) applied to the developing sleeve 4*b* are also identical and are not changed with respect to both of the image formation and the sheet interval.

Similarly, the DC voltage (auxiliary DC 1) applied to the transfer residual toner uniformizing means 8 and the DC voltage (auxiliary DC 2) applied to the toner charge amount control means 7 are identical and are not changed with respect to both of the image formation and the sheet interval.

Figure 6:
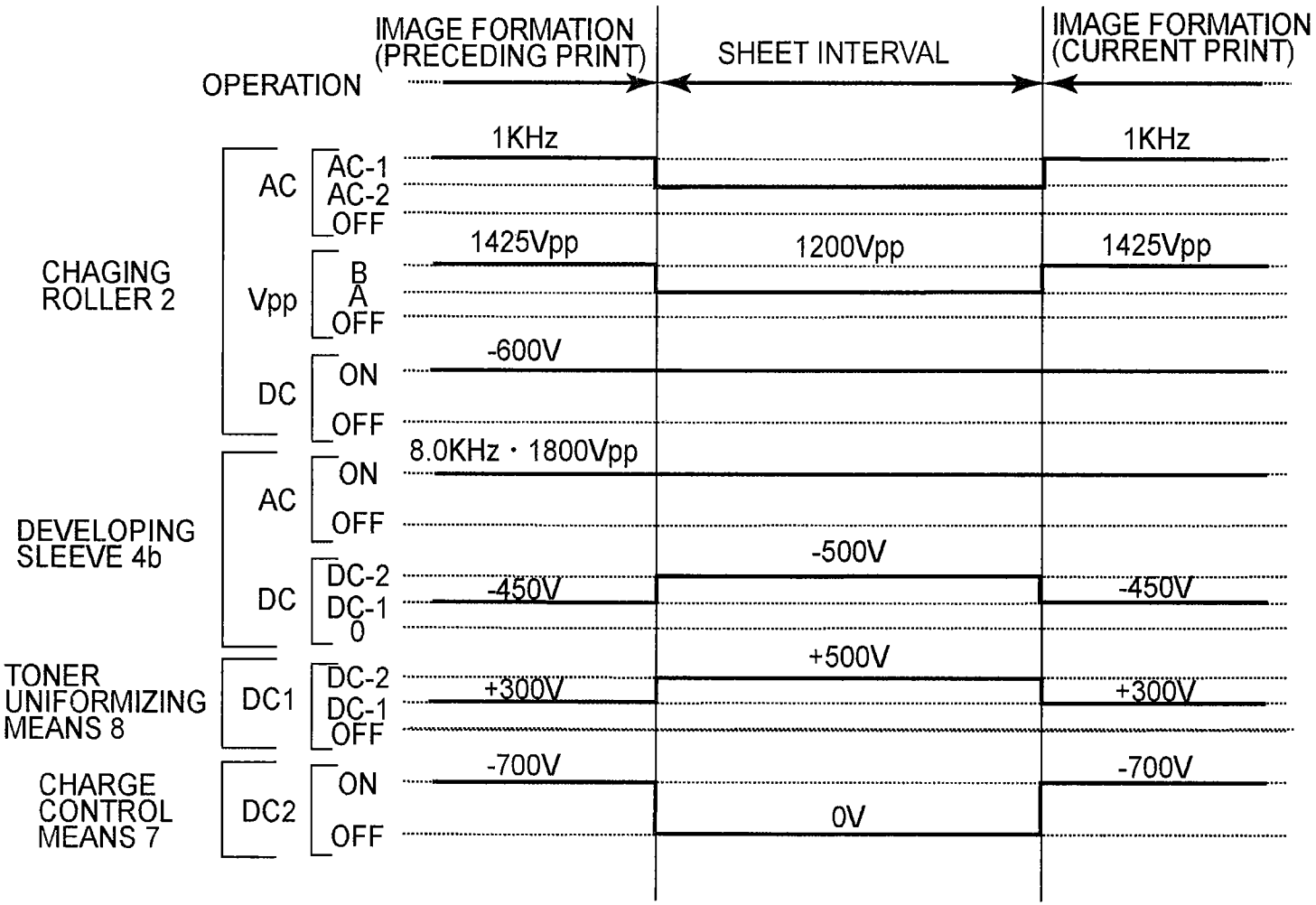
FIG. 6 is a time chart of sheet interval control of the image forming apparatus.

On the other hand, FIG. 6 is a time chart of sheet interval control in the image forming apparatus in this embodiment. In this embodiment, by the CPU 101 as the charge control means, the charging condition is changed between during the image formation and during the non-image formation as described below. Specifically, the AC voltages (charging AC and peak-to-peak voltage Vpp) and AC-1 and B, respectively, during the image formation but are changed to AC-2 and A, respectively, during the sheet interval. In the charging AC control, Vpp is changed and a charging frequency is constant at 1 kHz. In FIG. 6, the AC change timing and actually changed Vpp values are shown in combination.

The DC voltage (charging DC) applied to the developing sleeve 4*b* and the DC voltage (auxiliary DC1) applied to the transfer residual toner uniformizing means 8 are changed from DC-1 and DC-1, respectively, during the image formation to DC-2 and DC-2, respectively, during the sheet interval.

Further, the DC voltage (auxiliary DC2) applied to the toner charge amount control means 7 is in ON state during the image formation but is changed to OFF state during the sheet interval.

More specifically, as described above with reference to FIG. 8, when the AC voltage of not less than the discharge start peak-to-peak voltage (1200 Vpp at the point A in FIG. 8)

is applied to the charging roller 2, the drum 1 is electrically charged to a surface potential of about −600 V (macroscopically stable area). However, the surface of the drum 1 cannot be electrically charged uniformly, so that it is necessary to apply a peak-to-peak voltage of 1425 Vpp (point B in FIG. 8) calculated so as to provide a discharge current of 40 μA (target discharge current amount). By applying the peak-to-peak voltage of 1425 Vpp, the drum surface can be electrically charged uniformly without causing locally improper charging on the drum surface (microscopically stable area).

The locally improper charging occurring in the case of a low discharge current is particularly noticeable in the case of the image forming apparatus using the cleaner-less method as in this embodiment. This is because the transfer residual toner is present at the contact portion a between the charging roller 2 and the drum 1, so that the locally improper charging is caused to occur particularly at a surface portion where the transfer residual toner is present (the drum surface portion at the back surface of the transfer residual toner and the drum surface portion under the transfer residual toner). In the case where the peak-to-peak voltage not less than that providing the target amount of discharge current is applied to the charging roller 2, it is possible to electrically charge the drum surface portion where the transfer residual toner is present to a desired surface potential sufficiently.

In this embodiment, by applying the above-described phenomenon, the applied bias is controlled so that the reversely charged toner on the drum 1 is collected in the developing apparatus 4.

First, with respect to the AC voltage applied to the charging roller 2, the amount of the discharge current generated between the charging roller 2 and the drum 1 is switched between during the image formation and other periods at arbitrary timing. That is, the AC bias applied to the charging roller 2 is switched so as to provide a desired discharge current at each timing. In this embodiment, the peak-to-peak voltage of 1425 Vpp, providing the target discharge current of 40 μA, is applied during the image formation (the point B in FIG. 8). On the other hand, during the sheet interval, the peak-to-peak voltage of 1200 Vpp, providing the discharge current of 0 μA, is applied (the point A in FIG. 8).

Figure 9:
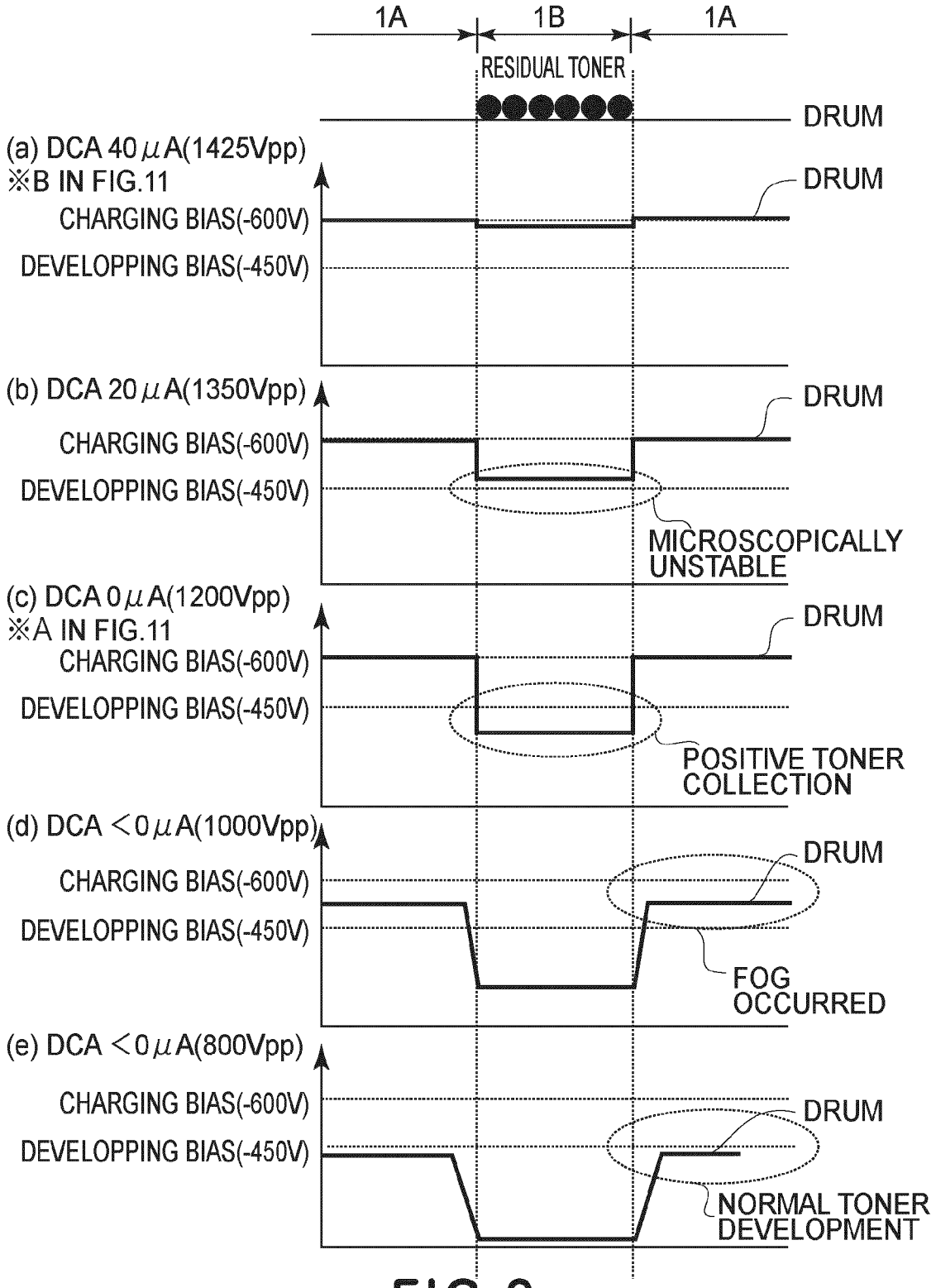
FIGS. 9(*a*) to 9(*e*) are schematic views each showing a relationship between a peak-to-peak voltage of a charging AC voltage and a surface potential of a photosensitive drum with presence and absence of transfer residual toner.

FIG. 9 is a schematic diagram for illustrating a state in which potentials of a drum surface 1A where the transfer residual toner is not present and a drum surface 1B where the transfer residual toner is present are changed in what manner with respect to the surface potential of the charging roller 2 when the peak-to-peak voltage Vpp applied to the charging roller 2 is changed. The surface potential of the charging roller 2 is the DC voltage, applied to the charging roller 2, of −600 V.

Here, a condition of the transfer residual toner when the potential of the drum surface 1B where the transfer residual toner is present is measured will be described. In order to provide a maximum density (of 1.6 as an optical reflection density (O.D.)) ensured by the printer 100 in this embodiment, the amount of toner on the recording material P is required to be about 0.65 mg/cm$^2$. Since an efficiency at which the toner can be transferred from the drum 1 onto the recording material P by the transfer roller 5 (so-called a transfer efficiency) is about 90-95%, the amount of toner subjected to the development on the drum 1 by the developing apparatus 4 is required to be about 0.7 mg/cm$^2$.

Therefore, as a condition providing a potential relationship between the peak-to-peak voltage Vpp applied to the charging roller 2 and surface potentials at the drum surfaces 1A and 1B, the amount of the transfer residual toner on the drum 1 is set to about 0.05 mg/cm$^2$. A tendency described below with reference to FIG. 9 is substantially identical in the range from about 0.01 mg/cm$^2$ to about 0.15 mg/cm$^2$ in terms of the amount of the transfer residual toner, so that the transfer residual toner amount is not limited to 0.05 mg/cm$^2$. In the case where the transfer residual toner amount is very small, e.g., less than 0.01 mg/cm$^2$, the transfer residual toner is mechanically scraped from the drum 1 by the magnetic brush of the magnetic carrier formed on the developing sleeve 4*b*. For this reason, the above-described problem does not arise even when the toner having the opposite polarity is present.

FIG. 9(*a*) shows the case of the peak-to-peak voltage of 1425 Vpp, providing a discharge current amount (DCA) of 40 μA, capable of electrically charging the drum surface sufficiently uniformly. In this case, both of the drum surface 1A and the drum surface 1B can be electrically charged to a desired potential of about −600 V, regardless of the presence or absence of the transfer residual toner.

FIG. 9(*b*) shows the case of the peak-to-peak voltage of 1350 Vpp, providing the discharge current amount of 20 μA, which is lower than that in the case of FIG. 9(*a*). In this case, the drum surface 1A where the transfer residual toner is not present can be electrically charged to the desired potential of about −600 V. However, the drum surface 1B where the transfer residual toner is present can only be electrically charged to about −500 V different from the case of FIG. 9(*a*). The reason thereof is as described above.

FIG. 9(*c*) shows the case of the peak-to-peak voltage of 1200 Vpp, providing the discharge current amount of 0 μA. Similarly as in the case of FIG. 9(*b*), the drum surface 1A where the transfer residual toner is not present can be electrically charged to the desired potential of about −600 V. However, different from the case of FIG. 9(*b*), the drum surface 1B where the transfer residual toner is present can only be electrically charged to about −400 V, so that the surface potential is lower than that of the developing sleeve 4*b* (the DC voltage of −450 V applied to the developing sleeve 4*b*). In other words, the reversely charged toner in the transfer residual toner reaching the developing portion c in the potential state of the drum surface 1B is removed and collected by the developing sleeve 4*b*. At the same time, the transfer residual toner component having the positive polarity is not collected in the developing apparatus 4 but is removed and collected by the developing apparatus through the cleaner-less system as described above when the charging condition is returned to a high voltage application condition (the state of FIG. 9(*a*)) during subsequent image formation.

FIG. 9(*d*) shows the case of the peak-to-peak voltage of 1000 Vpp, lower than that providing the discharge current amount of 0 μA. In this case, the drum surface 1A where the transfer residual toner is not present also cannot be electrically charged to the desired potential of −600 V, so that the toner is supplied for development from the developing apparatus 4 to the entire drum surface although an amount thereof is small.

FIG. 9(*e*) shows the case of the peak-to-peak voltage of 800 Vpp, which is further decreased in voltage value. In this case, the potential of the drum surface 1A where the transfer residual toner is not present is further decreased to be lower than the potential of the surface of the developing sleeve 4*b* (the DC voltage of −450 V applied to the developing sleeve 4*b*), so that a large amount of the toner is supplied for development to the entire drum surface.

Even in the cases of FIGS. 9(*d*) and 9(*e*), it is possible to remove and collect the reversely charged toner in the transfer residual toner by the developing apparatus 4, but at the same time, the large amount of the position polarity toner is subjected to the development on the drum 1 by the developing apparatus 4, so that there is a possibility of contamination of the transfer roller 5 with the toner.

Figure 10:
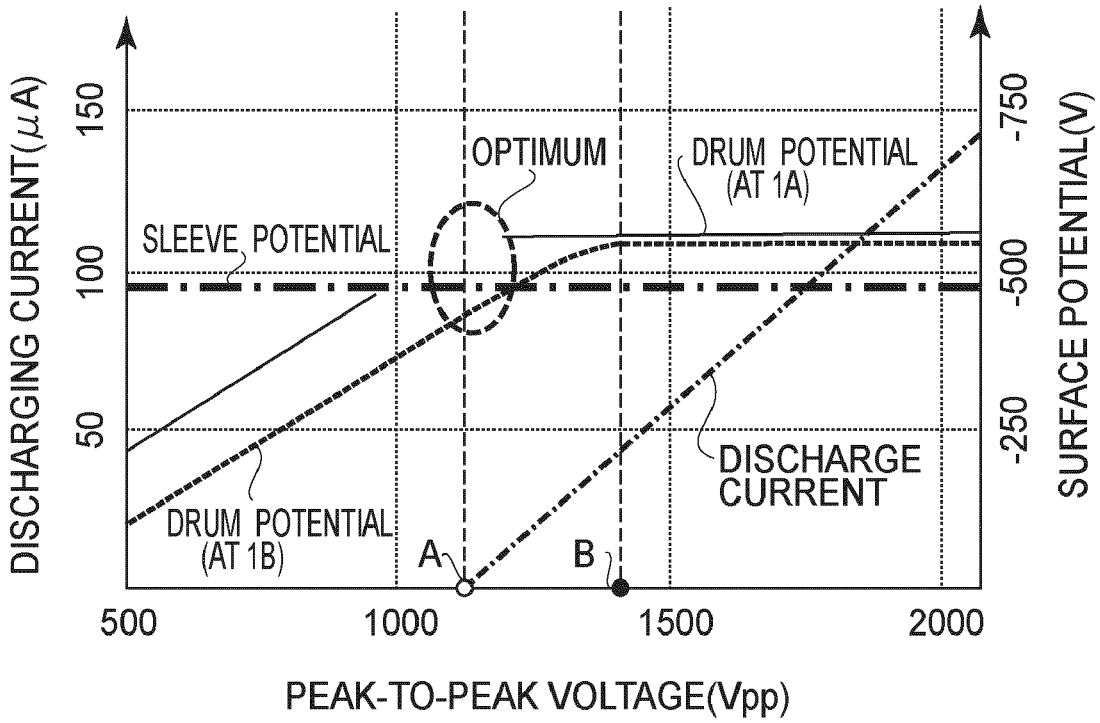
FIG. 10 is a graph showing a relationship between a peak-to-peak voltage of a charging AC voltage and a discharge current and a relationship between the charging AC voltage and surface potentials of a photosensitive drum and a developing sleeve.
Figure 11:
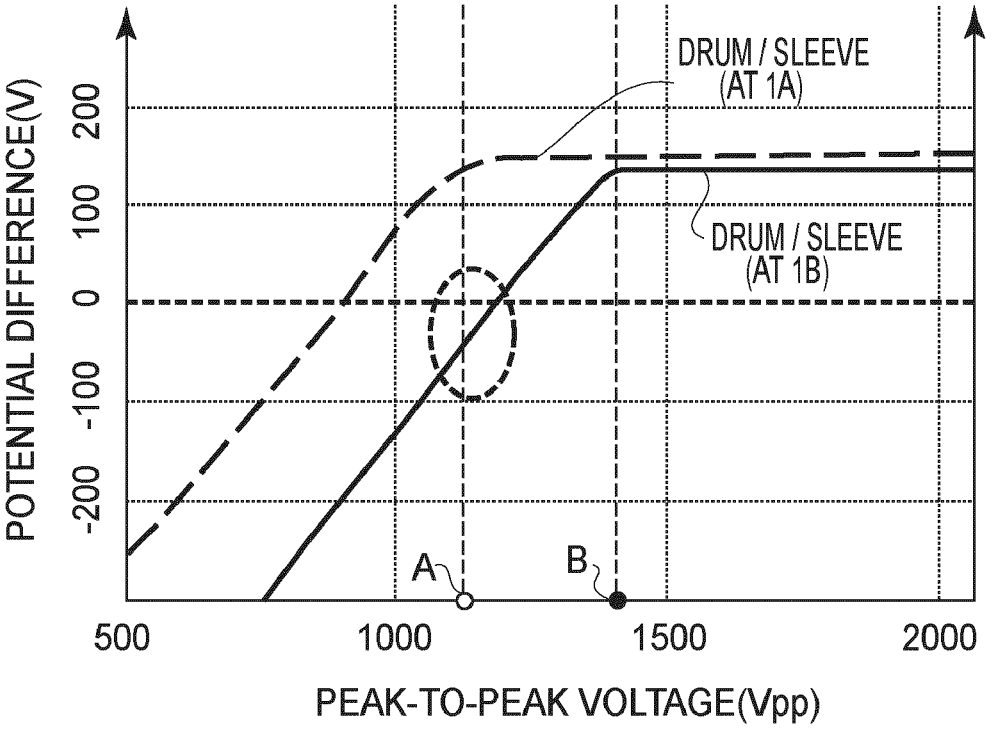
FIG. 11 is a graph showing a relationship between a peak-to-peak voltage of a charging AC voltage and a potential difference between a photosensitive drum and a developing sleeve.

The above-described relationships are summarized in FIGS. 10 and 11.

FIG. 10 is an interrelation view showing how the surface potential of the drum 1 (drum surface 1A) and the surface potential of the drum surface 1B, where the transfer residual toner is present, are changed with respect to the surface potential of the developing sleeve 4*b* when the peak-to-peak voltage applied to the charging roller 2 is changed. The surface potential of the developing sleeve 4*b* is the DC voltage of −450 V applied to the charging roller 4*b* as described above.

FIG. 11 is an interrelation view showing how a potential difference between the drum 1 (drum surface 1A) and the developing sleeve 4*b* is changed when the peak-to-peak voltage applied to the charging roller 2 is changed and showing how a potential difference between the drum surface 1B, where the transfer residual toner is present, and the developing sleeve 4*b* is changed when the peak-to-peak voltage applied to the charging roller 2 is changed.

From the above-mentioned explanation and FIGS. 10 and 11, the following two points 1) and 2) are optimum for removal and collection of the transfer residual toner by the developing apparatus 4.

1) The potential of the drum surface 1B when the transfer residual toner is present is lower than the surface potential (−450 V) of the developing sleeve 4*b*. In other words, a magnitude correlation between an absolute value of the surface potential of the image bearing member surface portion under the transfer residual toner and an absolute value of the surface potential of the image bearing member surface portion after the image bearing member surface is electrically charged by the above-described charging means is reversed with respect to that during the image formation.

2) The peak-to-peak voltage (close to the electric discharge start voltage) is applied to the charging roller 2 so that the potential of the drum surface 1A where the transfer residual toner is not present is substantially equal to the desired potential (the surface potential of the charging roller 2; −600 V). In this embodiment, the peak-to-peak voltage may preferably be in the range from 1100 Vpp to 1300 Vpp (specifically, 1200 Vpp (discharge current amount of 0 μA) in this embodiment) The peak-to-peak voltage close to the electric discharge start voltage may be within ±10% of the electric discharge start voltage.

In other words, the peak-to-peak voltage providing a discharge current capable of maintaining microscopic charge uniformity (causing no sandpaper-like fog) is applied to the charging roller 2 during the image formation. At arbitrary timing other than the period of the image formation, the peak-to-peak voltage providing a discharge current (substantially 0 μA) capable of maintaining a macroscopic charging property (a desired drum potential) is applied to the charging roller 2. By effecting such settings, the potential of the drum surface under the transfer residual toner cannot be increased up to the desired potential, so that the reversely charged toner (positive toner) is collected, at the developing portion c, on the developing sleeve 4*b* which is relatively charged negatively.

As described above, the peak-to-peak voltage applied to the charging roller 2 is decreased at the arbitrary timing during the non-image formation such as the sheet interval, compared with that during the image formation. As a result, it is possible to completely collect the transfer residual toner containing the reversely charged toner by the developing apparatus 4.

In this embodiment, the surface potential of the image bearing member surface portion where the transfer residual toner is present (the surface potential of the image bearing member surface portion under the transfer residual toner) was measured in the following manner.

An image of 10 mm square or more is formed on the image bearing member surface and rotation of the image bearing member is stopped after the image-formed surface of the image bearing member passes through the transfer means by which the image is transferred onto the intermediary transfer member, and the passes through the transfer residual toner uniformizing means, the toner charge amount control means, and the charging means and before the transfer residual toner on the surface of the image bearing member enters the developing means. The transfer residual toner on the image bearing member surface is sucked and removed by a dust eliminating cleaner. Therefore, a surface potential at an area from which the transfer residual toner on the image bearing member is removed is measured by using a surface electrometer ("Model 344", mfd. by TREK JAPAN) and a 5 mm-square problem ("Model 555P-1"). A bias applied to the charging means is determined so that the measured potential is the above-set potential.

In this embodiment, in order to further enhance the reversely charged toner collecting effect, the following control is also effected at the same time. This control increases the potential difference between the potential of the drum surface and the potential of the sleeve surface by minimizing the potential of the drum surface under the transfer residual toner. Further, in order to increase the amount of the electric charge of the reversely charged toner, by the control circuit (CPU) 101 as the auxiliary charge control means, the DC bias of a polarity opposite to the charge polarity of the drum and the toner is applied to the auxiliary charging means or increased compared with that applied during the image formation.

With respect to the DC voltage (developing DC) applied to the developing sleeve 4*b*, the DC voltage of DC1=−450 V is applied during the image formation. On the other hand, the DC voltage of DC-2=−500 V is applied during the sheet interval.

This is because a range of the peak-to-peak voltage capable of providing the potential, of the drum surface 1B where the transfer residual toner is present, lower than the surface potential of the developing sleeve 4*b* and capable of providing the potential, of the drum surface 1A where the transfer residual toner is not present, substantially equal to the desired potential, can be extended. In addition, it is also because the reversely charged toner can be efficiently removed and collected by the developing apparatus 4.

With respect to the DC voltage (auxiliary DC2) applied to the toner charge amount control means 7 as the auxiliary charging means, the DC voltage of DC-1=−700 V is applied during the image formation. On the other hand, the DC voltage of DC-2=0 V (no voltage application) is applied during the sheet interval by the control circuit (CPU) 101 as the auxiliary charge control means.

There are two reasons why the DC voltages (auxiliary DC1 and auxiliary DC2) applied to the transfer residual toner uniformizing means 8 and the toner charge amount control means 7 are changed between during the image formation and during the sheet interval.

The first lies in the action against the drum 1. During the image formation, the DC voltage of −700 V is applied to the toner charge amount control means 7 immediately before the charging roller 2, so that the surface of the drum 1 is electrically charged uniformly to some extent by the toner charge amount control means 7. Specifically, in the case where the DC voltage of −700 V is applied to the toner charge amount control means 7, the potential of the drum surface before the charging roller 2 is about −350 V, thus acting as an auxiliary means for electrically uniformly charging the drum surface by the charging roller 2, a pre-charging effect. For this reason, even when the peak-to-peak voltage applied to the charging roller 2 is changed to 1200 Vpp providing the discharge current close to 0 μA, the potential of the drum surface 1B, where the transfer residual toner is present, is not largely different from the potential of the drum surface 1A, where the transfer residual toner is not present, in some cases. Therefore, during the sheet interval, in order to reduce the pre-charging effect by the toner charge amount control means 7, the DC voltage applied to the toner charge amount control means 7 is set to 0 V (no voltage application).

On the other hand, to the transfer residual toner uniformizing means 8, the DC voltage of +300 V is applied during the image formation, so that the potential of the drum 1 after passing through the transfer portion d is removed. Specifically, in the case where the DC voltage of +300 V is applied to the transfer residual toner uniformizing means 8, the potential of the surface of the drum 1 after passing through the transfer residual toner uniformizing means 8 is about −100 V. In this way, by sufficiently removing the potential of the drum surface before the charging roller 2, a load on the charging process of the drum surface by the charging roller 2 is increased. As a result, it is possible to increase the potential of the drum surface 1B, where the transfer residual toner is present, compared with the potential of the drum surface 1A, where the transfer residual toner is not present. In this embodiment, during the sheet interval, the DC voltage of +500 V is applied to the transfer residual toner uniformizing means 8 so that the potential of the drum surface after passing through the transfer residual toner uniformizing means 8 is about 0 V.

As described above, in this embodiment, the DC voltages applied to the transfer residual toner uniformizing means 8 and the toner charge amount control means 7 are changed between during the image formation and during the sheet interval. As a result, it is possible to further increase the potential difference, between the potential of the drum surface where the transfer residual toner is present and the potential of the drum surface where the transfer residual toner is not present, generated in the case where the peak-to-peak voltage applied to the charging roller 2 is lowered. As a result, the removal and collection of the transfer residual toner by the developing apparatus 4 can be more efficiently performed.

The second lines in the action against the charge amount of the transfer residual toner. As described above, in the printer of this embodiment, the charge amount of the transfer residual toner is controlled to that of the normal charge polarity by the transfer residual toner uniformizing means 8 so as to be suitable for electrical discharge and uniformization by the transfer residual toner uniformizing means 8, and then is controlled by the toner charge amount control means 7 so as to be suitable for the removal and collection of the transfer residual toner by the developing apparatus 4.

However, the charge amount control of the transfer residual toner by the transfer residual toner uniformizing means 8 and the toner charge amount control means 7 is effective during the ordinary image formation but is not so effective with respect to the removal and collection of the reversely charged toner by the developing apparatus 4 performed during the sheet interval. In other words, as described above, with respect to the removal and collection by the developing apparatus 4 by decreasing the peak-to-peak voltage for the charging roller 2 to change the potential of the drum surface 1B where the transfer residual toner is present, a larger absolute value of the charge amount of the reversely charged toner is advantageous.

More specifically, the DC voltage applied to the transfer residual toner uniformizing means 8 is changed from +300 V during the image formation to +500 V during the sheet interval and the DC voltage applied to the toner charge amount control means 7 is changed from −700 V during the image formation to 0 V (OFF) during the sheet interval. As a result, into the transfer residual toner, an electric charge of a polarity opposite to the normal charge polarity is injected, so that it is possible to more efficiently perform the removal and collection of the transfer residual toner by the developing apparatus 4.

Figure 12:
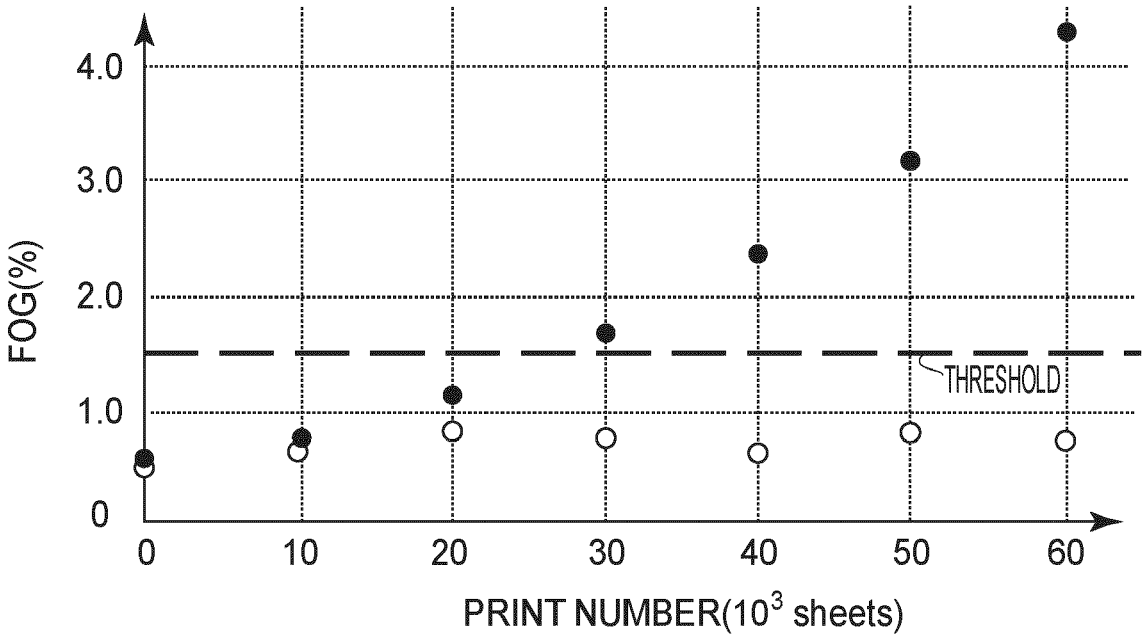
FIG. 12 is a graph showing a relationship between a print number and an amount of fog with respect to a conventional image forming apparatus and the image forming apparatus of the present invention.

FIG. 12 is a graph showing a relationship between a fog density and a print number with respect to the case where the above-described reversely charged toner collection control is effected ("○ (white circle)" in FIG. 12) and the case where the reversely charged toner collection control is not effected ("● (black circle)" in FIG. 12).

In the case where the control is carried out, the fog density is substantially not changed. On the other hand, in the case where the control is not carried out, it is found that the fog density exceeds its threshold of 1.5%, which is a limit of an occurrence of fog, at a print number of about $25\times10^3$ sheets to worsen a degree of fog occurrence with an increase in print number.

By executing the above-described reversely charged toner collection control, it is possible to prevent the toner having the opposite charge polarity from being carried and moved on the drum 1 without being completely collected by the developing apparatus 4. Therefore, it is possible to provide a stable image forming apparatus free from an occurrence of image failure such as fog, for a long period, caused by carrying and moving the toner.

In this embodiment, the reversely charged toner collection control sequence is carried out during the sheet interval in the continuous image forming mode but may also be set so as to be carried out during the post-processing operation after completion of the image forming job, during the warming operation, or during the pre-print rotation operation. The reversely charged toner collection control sequence may also be set to be performed during all of, one of or some of periods with respect to during the non-image formation inclusive of the warming operation, the pre-print rotation operation, the sheet intervals, and the post-processing operation. The reversely charged toner collection control sequence may also be performed during predetermined non-image formation, such as during the sheet interval, with timing at which a predetermined print number for image formation is counted up.

Further, image formation conditions are recorded (stored) by the storing apparatus (ROM or RAM) provided to the control circuit 100 and then the reversely charged toner collection control sequence may also be carried out during the predetermined non-image formation as during the sheet interval with timing at which the recorded value reaches a pre-set threshold. This is one of means for preventing an increase in amount of the reversely charged toner due to deterioration of the magnetic carrier accommodated in the developing apparatus 4 with the increase in the print number for image formation as described above.

Further, the reversely charged toner contained in the transfer residual toner varies in amount depending on an operational environment of the image forming apparatus, so that the presence or absence of execution of the reversely charged toner collection control sequence and the high voltage condition may be changed appropriately depending on a detection result by an environment sensor 104, for detecting a temperature and a humidity, provided to the image forming apparatus. This is one of means for preventing an increase in amount of the reversely charged toner in the transfer residual toner caused by much application of the DC voltage of the polarity opposite to the normal charge polarity of the toner in the transfer step since the charge amount of the toner is increased and a distribution of the charge amount has a broad shape in a low humidity environment.

The reversely charged toner collection control sequence may also be carried out with timing at which an amount of the transfer residual toner on the drum detected by, e.g., a light reflection-type density sensor 105 provided to the image forming apparatus reaches a pre-set threshold.

Further, in this embodiment, as the auxiliary charging member, two members consisting of the transfer residual toner uniformizing means 8 and the toner charge amount control means 7 are provided but the auxiliary charging member may also be a single member or omitted. In accordance with the number of the auxiliary charging member, it is possible to appropriately change the reversely charged toner collection control sequence.

Here, a discharging and collecting method of the reversely charged toner from the charging roller itself will be described. At arbitrary timing other than during the image formation, the DC voltage (of the negative polarity in this embodiment) is applied to the toner charge amount control means. Then, the surface of the image bearing member is electrically charged and a sequence for changing the DC voltage (of the negative polarity during the image formation in this embodiment) applied to the charging means (charging roller) to 0 V (OFF) is performed. By this sequence, an interrelationship between potentials of the charging means surface and the image bearing member surface is such that the image bearing member surface is negative with respect to the charging means surface, so that it is possible to discharge the positive-polarity toner deposited to the charging means surface to the image bearing member surface.

Other Embodiments

1) The contact charging means 2 is not limited to a roller member in the above-described embodiment. The contact charging means 2 may also be in the shape of a rotation belt member, a magnetic brush, or a far brush.

2) The rotating image bearing member 1 is not limited to a drum-type member but may also be shaped in a rotation belt member. Further, the image bearing member is not limited to the electrophotographic photosensitive member in the above-descried embodiment but may also be an electrostatic recording dielectric member. In this case, as an information writing means, it is possible to use an electrically discharging needle array, an ion irradiation scanning apparatus, or the like for selectively electrically discharging a charging surface of the electrostatic recording dielectric member to form an electrostatic latent image.

3) In the case where the image bearing member is the electrophotographic photosensitive member, the image exposure means 3 as the information writing means for forming the electrostatic latent image is not limited to the laser scanning exposure means but may also be other digital exposure means such as an LED array. The exposure means 3 may also be an analog exposure means such as an image projecting apparatus. Further, it is also possible to use various image exposure means such as a combination of a light source such as a fluorescent lamp with a liquid crystal shutter, or the like, so long as the means is capable of forming the electrostatic latent image corresponding to the image information.

4) The developing means 4 is also not particularly limited. The means is not restricted to the reversal developing apparatus but may also be a normal developing apparatus. Generally, the developing method for developing the electrostatic latent image with the toner is roughly classified into four types including a one-component non-contact developing method, a one-component contact developing method, a two-component contact developing method, and a two-component non-contact developing method.

The one-component non-contact developing method is a method in which non-magnetic toner is applied with a blade or the like onto a developer carrying and conveying member such as a sleeve or the like or magnetic toner is applied onto the developer carrying and conveying member by a magnetic force and then the resultant toner is caused to act on the image bearing member in a non-contact state to develop an electrostatic latent image.

The one-component contact developing method is a method in which the non-magnetic toner or the magnetic toner applied onto the developer carrying and conveying member as described above is caused to act on the image bearing member in a contact state to develop the electrostatic latent image.

The two-component contact developing method is a method in which a two-component developer containing toner and a magnetic carrier in mixture is conveyed by the magnetic force and caused to act on the image bearing member in the contact state to develop the electrostatic latent image.

The two-component non-contact developing method is a method in which the two-component developer is caused to act on the image bearing member in the non-contact state to develop the electrostatic latent image.

5) The image forming apparatus may be an apparatus by forming a multi-color or full-color image by using an intermediary transfer member of a drum type or a belt type. The image forming apparatus is not limited to the printer but may also be a copying machine, a facsimile apparatus, a multi-function machine of these apparatuses, and the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 328097/2006 filed Dec. 5, 2006, which is hereby incorporated by reference.

What is claimed is:

1. An image forming apparatus comprising:

a rotatable photosensitive member;

a charging device for electrically charging said rotatable photosensitive member by being supplied with a charging bias in the form of a DC voltage biased with an AC voltage;

an exposure device for exposing said rotatable photosensitive member electrically charged by said charging device to form an electrostatic latent image;

a developing device for developing said electrostatic latent image in to a toner image;

a transfer device for transferring said toner image onto an image receiving member;

an adjusting device, disposed downstream of said transfer device and upstream of said charging device with respect to a rotational direction of said photosensitive member and disposed in contact with said photosensitive member, for adjusting an electric charge of residual toner remaining on said photosensitive member without being transferred onto said image receiving member; and a control device for controlling said charging bias so that a first AC bias is applied to said charging device during image formation and for controlling said charging bias so that a second AC bias is applied to said charging device during non-image formation;

wherein a developing bias is applied so that an absolute value of a difference between a potential of an area, of said photosensitive member charged by application of said second AC bias, in which said residual toner is deposited, and a developing bias to be applied during non-image formation is larger than an absolute value of a difference between a potential of an area, of said photosensitive member charged by application of said second AC bias, in which the residual toner is not deposited, and a developing bias to be applied during non-image formation, thereby to collect said residual toner deposited on said photosensitive member.

2. An apparatus according to claim 1, wherein said adjusting device adjusts said electric charge so that a polarity of said residual toner is a normal polarity during image formation and so that the polarity of said residual toner is an opposite polarity during non-image formation.

3. An apparatus according to claim 1, wherein said second AC bias is applied to said charging device during non-image formation so that an amount of a discharge current passing between said photosensitive member and said charging member is substantially zero.

* * * * *